United States Patent [19]

Conti

[11] Patent Number: 4,875,423

[45] Date of Patent: Oct. 24, 1989

[54] OVEREDGE STITCH SEAM

[75] Inventor: Roberto Conti, Milan, Italy

[73] Assignee: Conti Complett S.P.A., Italy

[21] Appl. No.: 76,163

[22] Filed: Jul. 21, 1987

[30] Foreign Application Priority Data

Jul. 28, 1986 [IT] Italy ..... 21280 A/86

[51] Int. Cl.[4] ..... D05B 93/00

[52] U.S. Cl. ..... 112/438; 112/441

[58] Field of Search ..... 112/162, 268.1, 269.1, 112/425, 433, 436, 437, 438, 441

[56] References Cited

U.S. PATENT DOCUMENTS

| | | | |
|---|---|---|---|
| 811,789 | 2/1906 | Onderdonk | 112/436 |
| 1,612,819 | 1/1927 | Huber | 112/441 X |
| 3,373,706 | 3/1968 | Armstead, Jr. | 112/162 |
| 3,431,876 | 3/1969 | Russell | 112/433 |
| 4,117,792 | 10/1978 | Navlyt | 112/433 |

FOREIGN PATENT DOCUMENTS 30154433 11/1981 Fed. Rep. of Germany .

*Primary Examiner*—Wm. Carter Reynolds

*Attorney, Agent, or Firm*—Roylance, Abrams, Berdo & Goodman

[57] ABSTRACT

In an overedge stitch type consisting of two needle threads, one looper thread and a workpiece carrying these threads, loops of the needle threads are arranged at different spacings parallel to the edge of the workpiece within the latter. In addition, these loops of the needle threads may also exhibit different spacing from the workpiece edge.

5 Claims, 6 Drawing Sheets

OVEREDGE STITCH SEAM

The invention relates to an overedge stitch type consisting of two needle threads and one looper thread and also of a workpiece joined by these threads, with loops of the needle threads arranged at a distance from the edge of the workpiece within the latter.

The invention also relates to a method and an apparatus for the production of such a stitch type, with the apparatus comprising two thread-guiding needles oscillating jointly in the same direction at a predetermined spacing, an oscillating, thread-guiding looper and a feed mechanism for the workpiece.

An overedge stitch type of the aforementioned kind is known from the standard sheet ISO 4915/1981 (E/F) under No. 521. This stitch type is used, in particular, in the joining of knitted fabrics with an open cut edge which are to be simultaneously hemmed by the threads forming the stitch. The stitch type is also used, in particular, for closing the points of stockings or socks, in which case, a common overedge stitch sewing machine may be employed. Such machines comprise, in turn, two thread-guiding needles penetrating at mutual spacing the workpiece which is to be sewn, a thread-guiding looper and, possibly, a spreader for supporting the stitch formation. The workpiece, for example, a stocking or a sock, is moved through the stitch formation zone by a feed dog which cooperates with a pressor foot. Toothed or rubber covered bars and needle rims as well as gear wheels may, for example, serve as feeding device.

Stitch type No. 521 and the apparatus used for its production have proven unsatisfactory in the closing of the points of stockings or socks. The needle thread loops arranged perpendicularly to the workpiece edge at a relatively small spacing within the workpiece easily cause a bulging material displacement, with the result that the seam, if arranged at a stocking or sock point, presses in an unpleasant way against the foot.

Furthermore, a seam sewn with the known stitch type No. 521 has a relatively low elasticity. This produces tensions in the seam while a sock sealed in this way is being worn, which may cause mesh runs. Finally, the common workpiece feed mechanism on conventional overedge stitch sewing machines may also easily lead to an irregular feeding and an uneven seam.

Attempts have already been made to eliminate the disadvantages of the overedge stitch type No. 521 by the stocking or sock point being closed with two two-thread overedge stitch types sewn successively, in which case each stitch type includes one needle thread and one looper thread. Apart from the fact that an apparatus for producing two such stitch types is extremely elaborate, the seam produced from two superimposed stitch types is also very bulky and likewise forms a bulge. Finally, the thread consumption of the double seam consisting of a total of four threads is substantially larger than in an overedge seam with only three threads, in accordance with the stitch type in question.

The object underlying the invention is to alter a generic overedge stitch type in such a way that the aforementioned disadvantages of stitch type No. 521 are avoided, that is, to obtain a firm, possibly non-bulging, yet resilient union.

A further object of the invention is to provide a method for the production of such a stitch type and a simple apparatus for performing this method.

The object is attained in accordance with the invention in that in a generic overedge stitch type, the loops of the needle threads are staggered in relation to each other parallel to the edge of the workpiece.

This staggering of the needle thread loops—or what amounts to the same—the needle entering and exiting points on the workpiece—parallel to the workpiece edge make the seam less bulky than the known overedge stitch seams and, in particular, there is no formation of an annoying bulge.

On account of the staggered needle penetrations, the seam is also more elastic than the hitherto known seams. Furthermore, the staggered arrangement of the needle entering and exiting points in the feed or sewing direction, with the same stitch spacing (stitch length), results in higher sewing speeds than hitherto.

The following description of a preferred embodiment serves in conjunction with the appended drawings to explain the invention in further detail.

Figure 1:
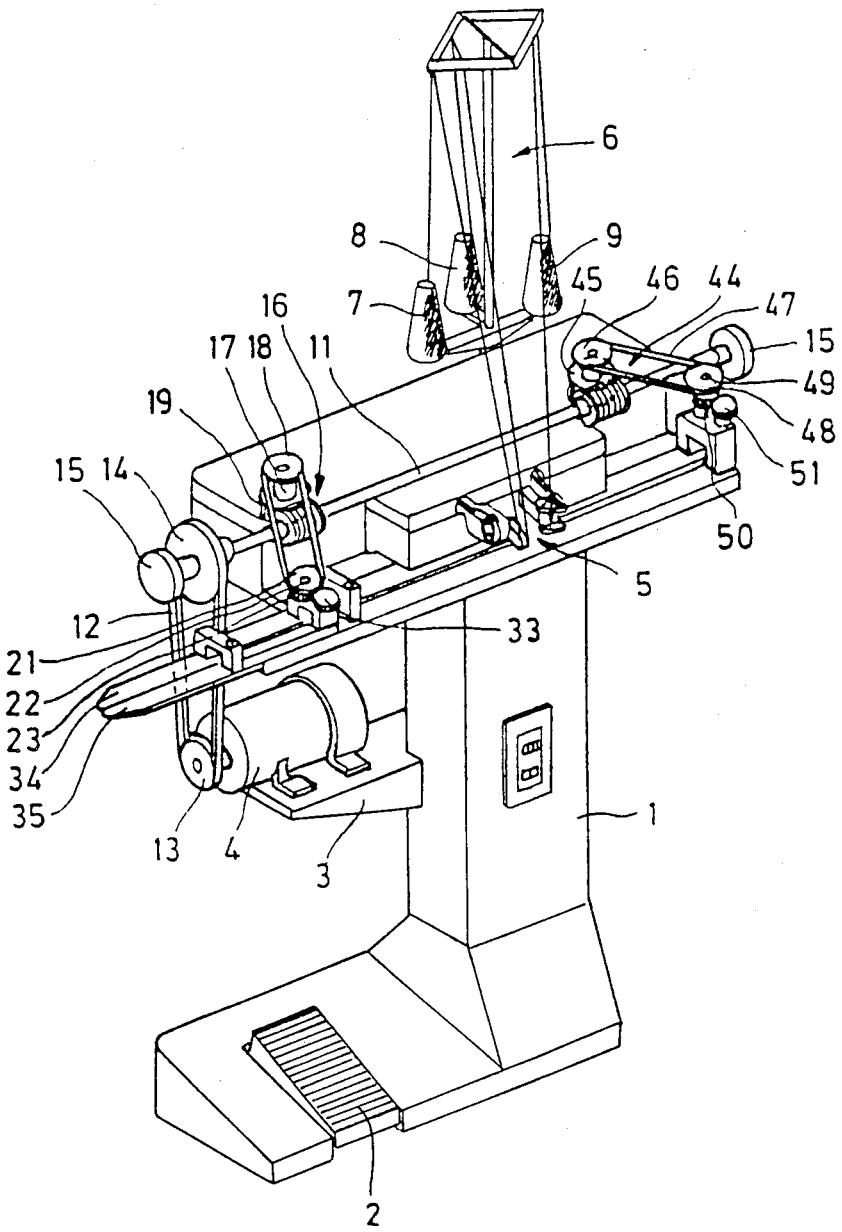
FIG. 1 shows a sewing apparatus.

The sewing apparatus shown in the drawings comprises a common column-type base 1 with an operating pedal 2, a bracket 3 for a drive motor 4 and a sewing machine designated in general by reference numeral 5. Attached to the column-type base 1 is a thread post 6 carrying thread spools 7, 8, 9.

The sewing machine 5 comprises a main shaft 11 which is connected via a belt 12 and pulleys 13, 14 to the drive motor 4. Hand wheels 15 at both ends of the main shaft 11 serve in the conventional manner to drive the sewing machine by hand.

Figure 3:
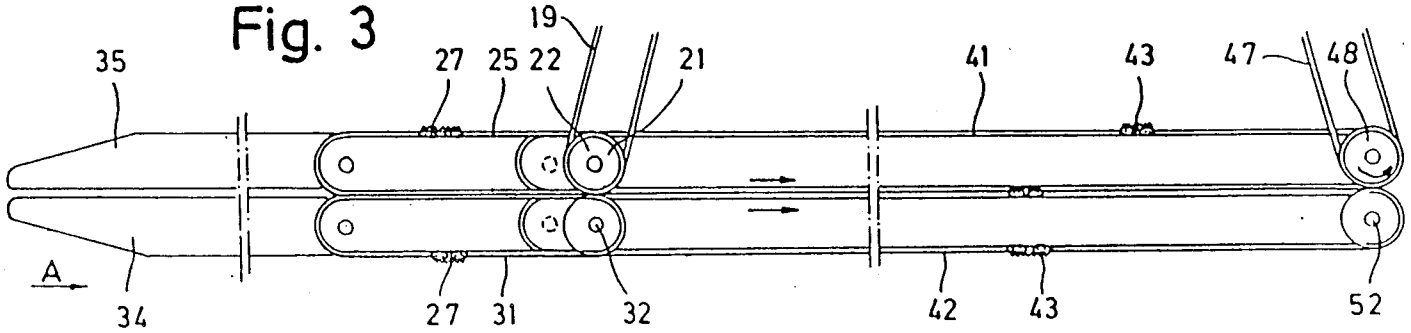
FIG. 3 shows a workpiece feed meachanism for the apparatus of FIGS. 1 and 2.

Attached to the main shaft 11 is a first worm drive 16 which drives a worm shaft 17 which, in turn, carries a pulley 18 at one end. The pulley 18 drives via a belt 19 a pulley 21 which is carried on a substantially vertically entending shaft 22. Attached to the shaft 22 is a gear 23 and below it a hidden chain wheel around which a first, front conveyor chain 25 is placed (FIG. 3), which is guided around a further hidden chain wheel at the workpiece inlet side (in FIG. 3 at the top).

The conveyor chain 25 is provided with teeth which penetrate a workpiece to be sewn and hold it in place.

A second conveyor chain 31 of the same kind is located opposite the conveyor chain 25 and is guided around hidden chain wheels, of which the one facing away from the inlet side is connected to a shaft 32 which, in turn, carries a gear 33 (FIG. 1). The gear 33 meshes with the gear 23, whereby the second chain is also driven. Extending in the direction opposite to the workpiece feed direction (arrow A in FIG. 3) beyond the front ends of the chains (25, 31) are guide rails 34, 35.

A further pair of conveyor chains consisting of chains 41, 42 with teeth 43 is arranged downstream from the conveyor chains 25, 31 in the workpiece feed direction A, with the chains 41, 42 and 25, 31 partly overlapping.

The conveyor chain 41 is driven by a second worm drive 44 on the main shaft 11. The worm drive 44 drives a worm shaft 45 with a pulley 46. The pulley 46 is connected by a belt 47 to a pulley 48, to whose shaft 49 a gear 50 is attached. The gear 50 meshes with a gear 51 on a shaft 52 to drive the conveyor chain 42.

The chains 25, 31 and 41, 42, respectively, are thus driven in an analogous manner.

Figure 2:
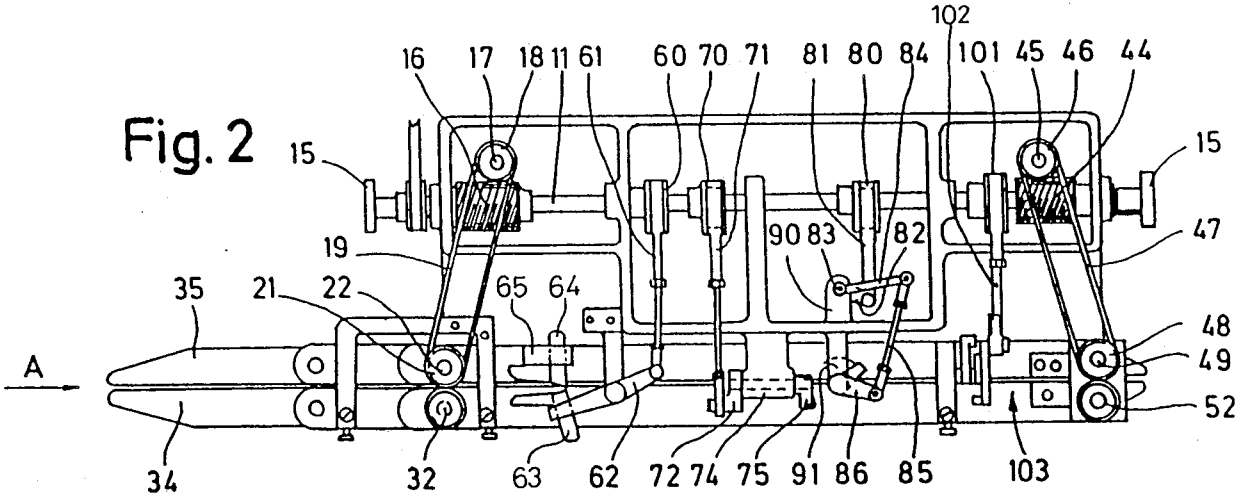
FIG. 2 is a top view of the sewing apparatus of FIG. 1.

On the main shaft 11 there furthermore is secured an eccentric cam 60 (FIG. 2) which is connected via a connecting rod 61 to a lever 62 which, in turn, carries a blade 63. The blade 63 cooperates with a blade 64 on a stationary holder 65 to cut off protruding workpiece edges or parts thereof prior to the sewing operation.

Figure 4:
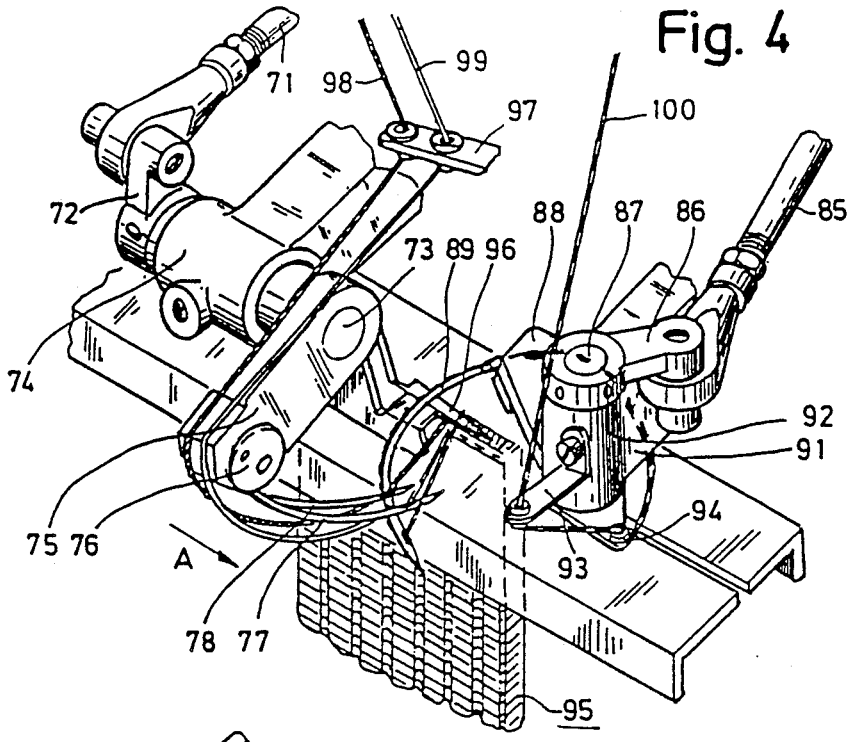
FIGS. 4 and 5 show the stitch formation zone of the sewing apparatus with the stitch forming tools in different positions.
Figure 5:
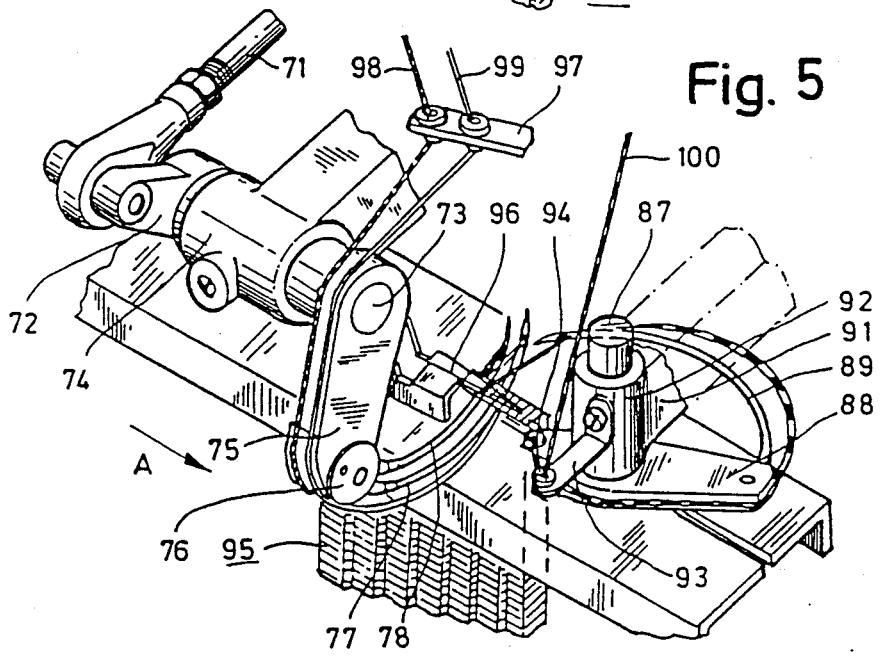
Figure 6:
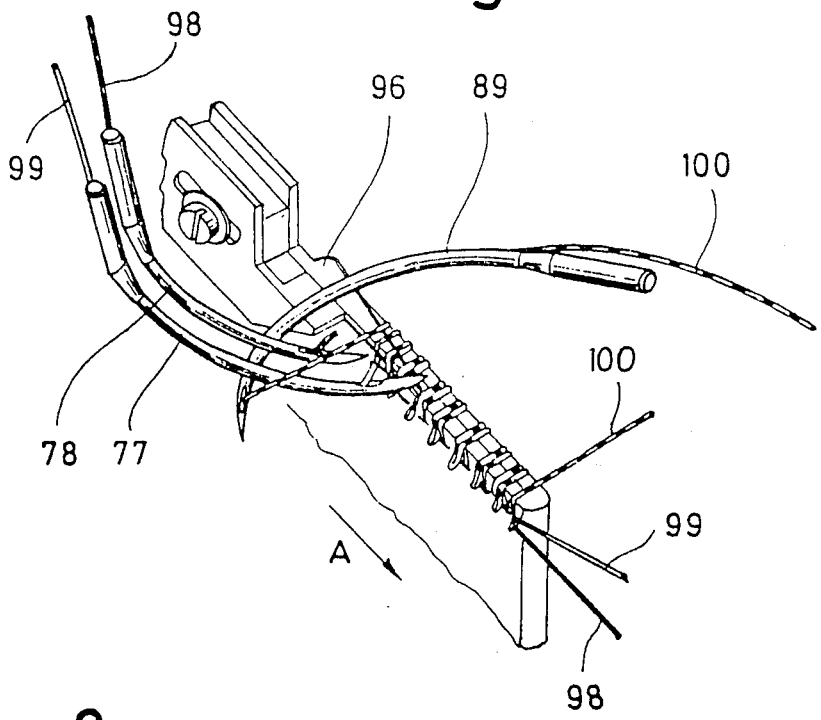
FIG. 6 is an enlarged section taken from FIG. 4.

A further eccentric cam 70 on the main shaft 11 drives a draw rod 71 which is connected via a lever 72 to a rocker shaft 73 (FIG. 4). The rocker shaft 73 extending substantially parallel to the feed direction A is mounted in a stationary bearing boss 74 of the machine hausing and carries at the other end a needle lever 75 to which two curved needles 77, 78 are attached by a needle holder 76. The needles 77, 78 are substantially equal long and are attached at a certain mutual spacing to the needle holder 76 so as to be driven jointly in the same direction in an oscillating manner by the eccentric cam 70. The needles extending substantially parallel to each other are spatially arranged in such a way that each time they strike the workpiece 95, both needle tips hit points illustrated in FIG. 8. In this Figure, the workpiece to be sewn which is conveyed in a hanging manner by the conveyor chains 25, 31, 41, 42 is designated by reference numeral 95 (see also FIGS. 4 and 5). The top workpiece edge which is to be hemmed is designated by reference numeral 117. The feed direction extends along arrow A. Each time the needle holder 76 strikes the illustrated workpiece side, the two needle tips hit points designated by B and C, respectively. These points of penetration B and C lie perpendicular to the workpiece edge 117 at a certain spacing from it, with the spacing from edge 117 of the points of penetration B being larger than the spacing from edge 117 of the points of penetration C. In addition, the points of penetration B are staggered in relation to the points of penetration C in the feed direction A parallel to the workpiece edge 117, and, more particularly, in the illustrated embodiment according to FIG. 8, by one half stitch length each, with the stitch length being determined by the distance between two successive points of penetration C or B. The points of penetration B are associated with the arcuate needle 78 and the points of penetration C with the curved needle 77.

The main shaft 11 furthermore carries an eccentric cam 80 which is connected to a connecting rod 81 which, in turn, is mechanically connected via a lever 82 to a substantially vertically extending shaft 83. The shaft 83 is connected via a further lever 84 to a rod 85 which drives a shaft 87 in an oscillating manner via a lever 86 (FIG. 4).

The shaft 87 carries a holder 88 with a needle-shaped looper or looper needle 89. The shafts 83 and 87 are mounted in freely protruding, stationary bearing arms 90 and 91, respectively, of which bearing arm 91 constitutes a bearing boss 92, on which a thread guide 93 is provided. The holder 88 carries a further thread guide 94.

The longitudinal axes of the shafts 73 and 87 driven in an oscillating manner are arranged obliquely in relation to each other in such a way that the looper 89 passes the needles 77, 78 on the needle entering and exiting side of the workpiece 95 on different sides, namely in front of or behind the needles.

A conventional stitch forming tongue 96 is provided (FIG. 4) for perfect stitch formation. Not illustrated but likewise provided are common thread control devices between the thread spools 9 and the thread guide 93 for a looper thread 100 and also between the spools 7, 8 and a thread guide 97 for the needle threads 98 and 99, respectively carried by the needles 77, 78. Finally there also is carried on the main shaft a further eccentric cam 101 (FIG. 2) which is provided via a connecting rod 102 with a device 103 for cutting off the thread chain formed between the individual workpieces 95.

Figure 7:
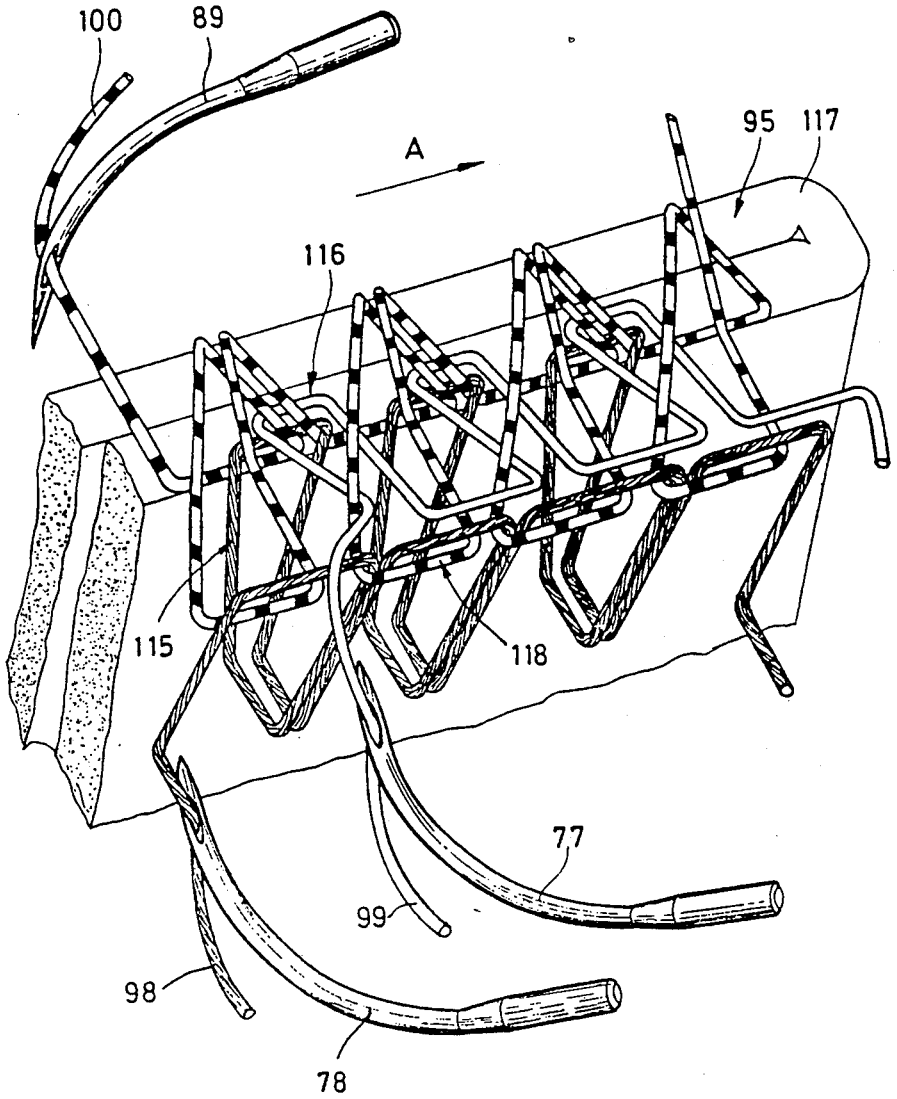
FIG. 7 shows a new overedge stitch type produced with the apparatus of FIG. 1.

To produce an overedge stitch type, as illustrated in FIG. 7, the needles 77, 78 carry the threads 98 and 99, respectively, through the workpiece 95. The threads 98, 99 form on the exit side of the needles 77, 78, on the workpiece 95 loops 115 and 116, respectively, through which the tip of the looper 89 is guided with its looper thread 100 departing from a position above or below the workpiece edge 117. The looper 89 carries the thread 100 as loop 118 both through the loops 115, 116 of the needle threads 98, 99 and around the workpiece edge to the other workpiece side, and the looper tip may lie there either above or below the workpiece edge 117.

Figure 8:
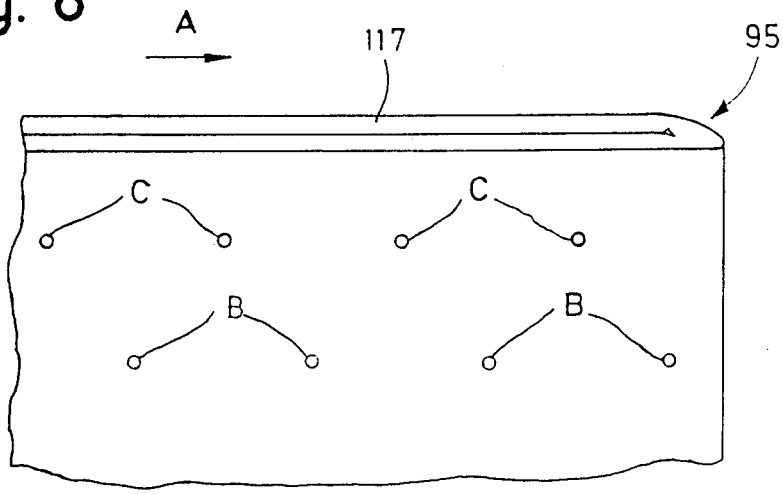
FIG. 8 is a schematic view of one side of a workpiece with needle penetration points.

At the same time, or shortly afterwards, the needles 77, 78 move back until they exit again at their points of penetration (B, C in FIG. 8). When they move forward again, the needles 77, 78 then go through the loops 118 of the looper thread 100 now lying on the needle entry side of the workpiece 95. Once the needles 77, 78 have entered these loops 118, the looper 89 returns to its starting position on the opposite workpiece side, whereby the initially formed needle thread loops 115, 116 are released. By appropriately tightening the threads, these are then drawn against the workpiece 95 in such a way that their interlooping lies at the exit point of the loop 116 of the needle thread 99. Thus, the loops of thread 98 at the needle exit points are drawn to the exit points of thread 99. The loop of the thread 98 guided by the needle 78 is pulled away from its exit point towards the exit point of the thread 99 guided by the needle 77.

After the looper 89 has returned from its rearward position, the operation is repeated. After the needles 77, 78 have withdrawn from the workpiece 95 and the loop 118 of the looper thread 100, the interloopings of the thread loops on the needle entry side of the workpiece 95 are also, as described hereinabove, drawn to the entry point of the loop of the thread 99.

Figure 9:
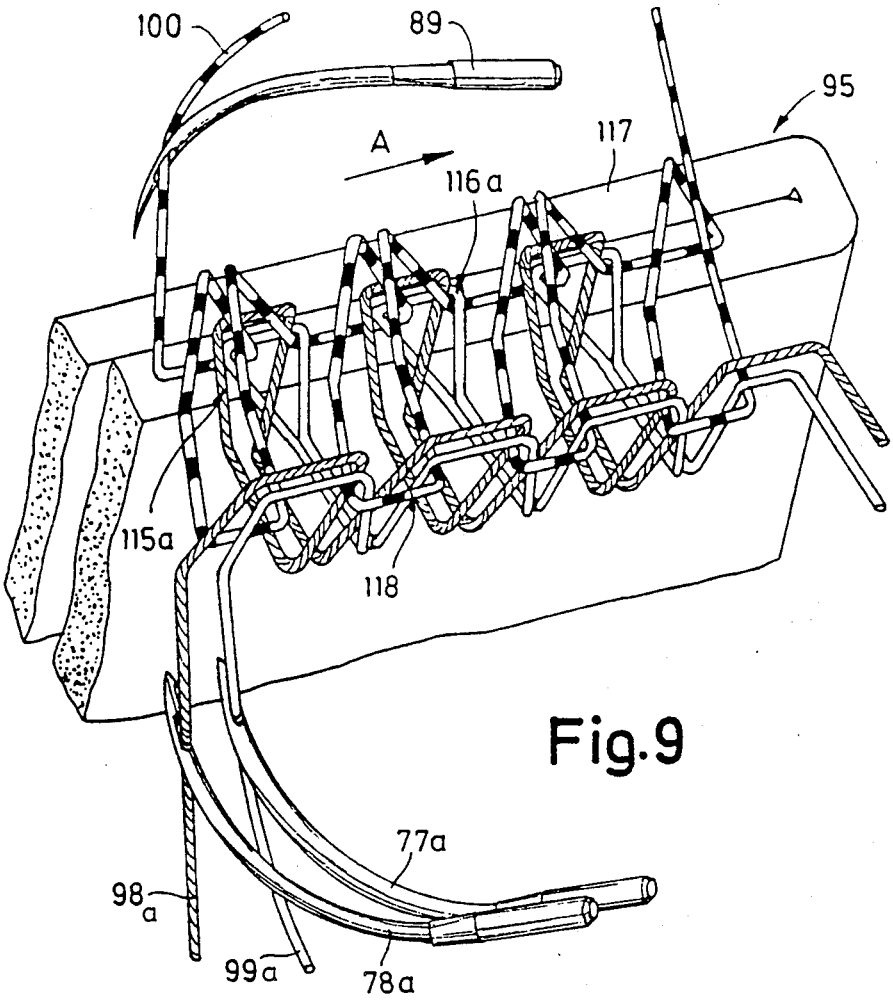
FIG. 9 is a view similar to FIG. 7 of a modified stitch type.
Figure 10:
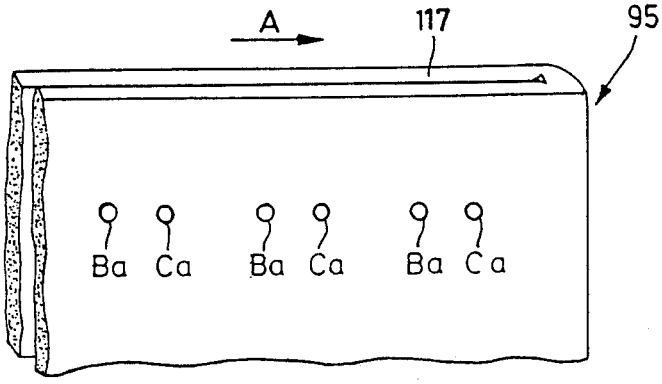
FIG. 10 is a view similar to FIG. 8 of the modified stitch type of FIG. 9.

The modified embodiment of an inventive overedge stitch type according to FIGS. 9 and 10 differs from the embodiment according to FIGS. 7 and 8 in that the entry and exit points $B_a$, $C_a$ (FIG. 10) and accordingly the two needles *77a, 78a* (FIG. 9) are staggered in relation to each other in one direction only, namely parallel to the sewing direction A or to the workpiece edge 117, but not in the direction perpendicular thereto, as in FIGS. 7, 8. In comparison to the prior art, this modified embodiment with only single staggering of the entry and exit points in the sewing direction is also advantageous.

In other modified embodiments of the invention, it is also possible, by alteration of the needle thread control, i.e., in particular, of the thread tension, to draw the mutual interlooping of the threads 98, 98*a;* 99, 99*a;* 100 to other points of the workpiece, preferably also to its edge. In the latter case, a particularly flat seam is obtained when the two workpiece parts which have been sewn together are spread out.

Also, by turning the feed direction A thorough 180°, a further modified embodiment with respect to the mutual positions of the thread interloopings may be obtained without any basic change to the stitch type.

According to FIG. 8, also the needles 77, 78 producing the points of penetration B and C, respectively, are, on account of their arrangement on the needle holder 76, staggered in relation to each other parallel to the workpiece edge 117 by less than one stitch length, namely by one half stitch length. In another embodiment of the invention which is not illustrated, the needles 77, 78 may also be arranged on the needle holder 76 in such a way that they are mutually staggered parallel to the workpiece edge 117 by more than one stitch length.

In both cases, however, it must be ensured that in the overedge stitch seam formed, all of the points of penetration B are staggered parallel to the workpiece edge in relation to all of the points of penetration C since only then are the advantages of the invention, e.g., higher sewing speeds, realizable.

I claim:

1. An overedge stitch seam, comprising:

a workpiece having a edge, a needle entry side and a needle exit side;

first and second needle threads entering said workpiece at distinct needle thread entry points on said needle entry side and formed into first and second loops arranged within said workpiece at a distance from said edge; and a looper thread formed into third loops, said first and second loops being formed together and always passing together through said third loops, said third loops arranged at said needle entry side being oriented transversely relative to said edge, each of said first and second loops extending from said needle exit side and interlooping with one of said third loops extending to downstream needle thread entry points at said needle entry side, said needle thread entry points and said first and second loops starting therefrom being staggered relative to each other parallel to said edge;

whereby each of said third loops receiving said first and second loops is fixed to said workpiece by one of said first and second loops if the other of said first and second loops is broken.

2. An overedge stitch seam according to claim 1, wherein said first and second loops are equally spaced from said edge of said workpiece.

3. A overedge stitch seam according to claim 1, wherein said first and second loops are arranged at different distances from said edge of said workpiece.

4. An overedge stitch seam according to claim 3, wherein said first and second loops are staggered in relation to each other by one half stitch length.

5. An overedge stitch seam according to claim 1, wherein said first and second loops are staggered in relation to each other by one half stitch length.

* * * * *